US006443225B1

(12) United States Patent
Nakanou et al.

(10) Patent No.: US 6,443,225 B1
(45) Date of Patent: Sep. 3, 2002

(54) THERMALLY CONTROLLED ACTIVE HEAT SWITCH SYSTEM

(75) Inventors: Akihiro Nakanou; Masao Shiraishi, both of Ibaraki-ken (JP)

(73) Assignee: Director General of Agency of Industrial Science and Technology, Tokyo (JP)

( * ) Notice: Subject to any disclaimer, the term of this patent is extended or adjusted under 35 U.S.C. 154(b) by 0 days.

(21) Appl. No.: 09/554,962

(22) PCT Filed: Mar. 31, 1999

(86) PCT No.: PCT/JP99/01702

§ 371 (c)(1),
(2), (4) Date: May 17, 2000

(87) PCT Pub. No.: WO99/60321

PCT Pub. Date: Nov. 25, 1999

(30) Foreign Application Priority Data

May 20, 1998 (JP) ..... 10/138245

(51) Int. Cl.[7] ..... F28F 27/00

(52) U.S. Cl. ..... 165/272; 165/96; 165/275; 165/276; 165/104.32

(58) Field of Search ..... 165/96, 96 HV, 165/272, 273, 274, 275, 276, 104.21, 104.32; 29/890.032

(56) References Cited

U.S. PATENT DOCUMENTS 3,327,772 A * 6/1967 Kodaira ..... 165/273
3,363,675 A * 1/1968 Bierhoff ..... 165/273 X
3,934,643 A 1/1976 Laing
4,341,000 A * 7/1982 Stockman ..... 165/104.32 X
4,756,164 A * 7/1988 James et al. ..... 165/104.21 X
4,955,207 A * 9/1990 Mink ..... 165/104.21 X
4,974,667 A * 12/1990 Sun et al. ..... 165/274 X
5,259,214 A * 11/1993 Nagatomo et al. .. 165/104.21 X
5,826,647 A * 10/1998 Engelhardt et al. . 165/104.21 X

FOREIGN PATENT DOCUMENTS

FR 2525757 * 10/1983 ..... 165/104.21
JP 5441148 12/1979
JP 4-185 * 1/1992 ..... 165/104.21

* cited by examiner

*Primary Examiner*—Ljiljana Ciric
(74) *Attorney, Agent, or Firm*—Martin A. Farber

(57) ABSTRACT

The present invention discloses a heat transfer changeover switch capable of effecting or cutting off positively heat transfer. The switch requires no contact or separation of a solid contact of a switch piece, is easily incorporated in a fine electronic device and generates no heat or vibration during a switch operation. The switch includes a heat pipe having a pipe for storing a heating medium therein disposed between a hot heat source and a cold heat source. A heating medium supplying/discharging device is provided for supplying/discharging the heating medium to and from the pipe. Heat transfer between the hot heat source and the cold heat source via the heat pipe is effected or cut off by using the heating medium supplying/discharging device that changes over between supply and discharge of the heating medium to and from the pipe.

1 Claim, 1 Drawing Sheet

THERMALLY CONTROLLED ACTIVE HEAT SWITCH SYSTEM

TECHNICAL FIELD

The present invention relates to a heat switch for switching between heat transmission and interruption of heat transmission between a hot zone and a cold zone. This technique can be used for controlling heat transmission (On) to and interruption of heat transmission (Off) of an electronic device and the like.

BACKGROUND ART

Members (superconducting members) made of superconducting material may be used for an electronic device and the like in some cases.

Such superconducting members are necessary to be maintained in an environment of an extremely low operating temperature. Therefore, a refrigerator that functions as a cold zone is used and a cold head of the refrigerator and the superconducting member to be cooled are connected through a heat pipe to maintain heat transmission between them. However, energy consumption increases when the refrigerator is always operating. Because the superconducting member has low resistance and a low calorific value, it is possible to maintain a heat conductive member in the operating environment of the extremely low temperature for a while by only interrupting the heat transmission to the superconducting member from the refrigerator even if operation of the refrigerator is stopped. At this time, a change-over switch for switching between heat transmission and interruption of heat transmission between the heat conductive member and the cold head of the refrigerator is necessary.

Although contact of and separation between a switch piece and a solid contact is used in a conventionally-conceived heat switch, incorporating such a change-over switch that requires mechanical movement into a minute electronic device adds many constraints to a structure and driving of the switch piece involves vibration or heat generation in many cases. Therefore, development of a change-over switch that can reliably switch between heat transmission and interruption of heat transmission, does not require contact of and separation between the switch piece and the solid contact, and does not generate heat or vibration during operation of the switch is desired.

The present invention has been accomplished with the above circumstance in view and it is an object of the invention to provide a change-over switch for heat transmission that can reliably switch between heat transmission and interruption of heat transmission, does not require contact of and separation between a switch piece and a solid contact, can be easily incorporated into a minute electronic device, and does not generate heat and/or vibration during operation of the switch.

DISCLOSURE OF THE INVENTION

Corresponding to the object, an active heat control heat switch system of the present invention includes a heat pipe having a pipe that can contain heating medium and disposed between a hot zone and a cold zone, and a heating medium supply and exhaust device for supplying and exhausting the heating medium to and from the pipe, wherein the system transmits heat and interrupts heat transmission between the intense heat source and the cold heat source through the heat pipe by switching between supplying and exhausting of the heating medium to and from the pipe by using the heating medium supply and exhaust device.

BEST MODE FOR CARRYING OUT THE INVENTION

The present invention will be specifically described below with reference to the drawings showing an embodiment.

Figure 1:
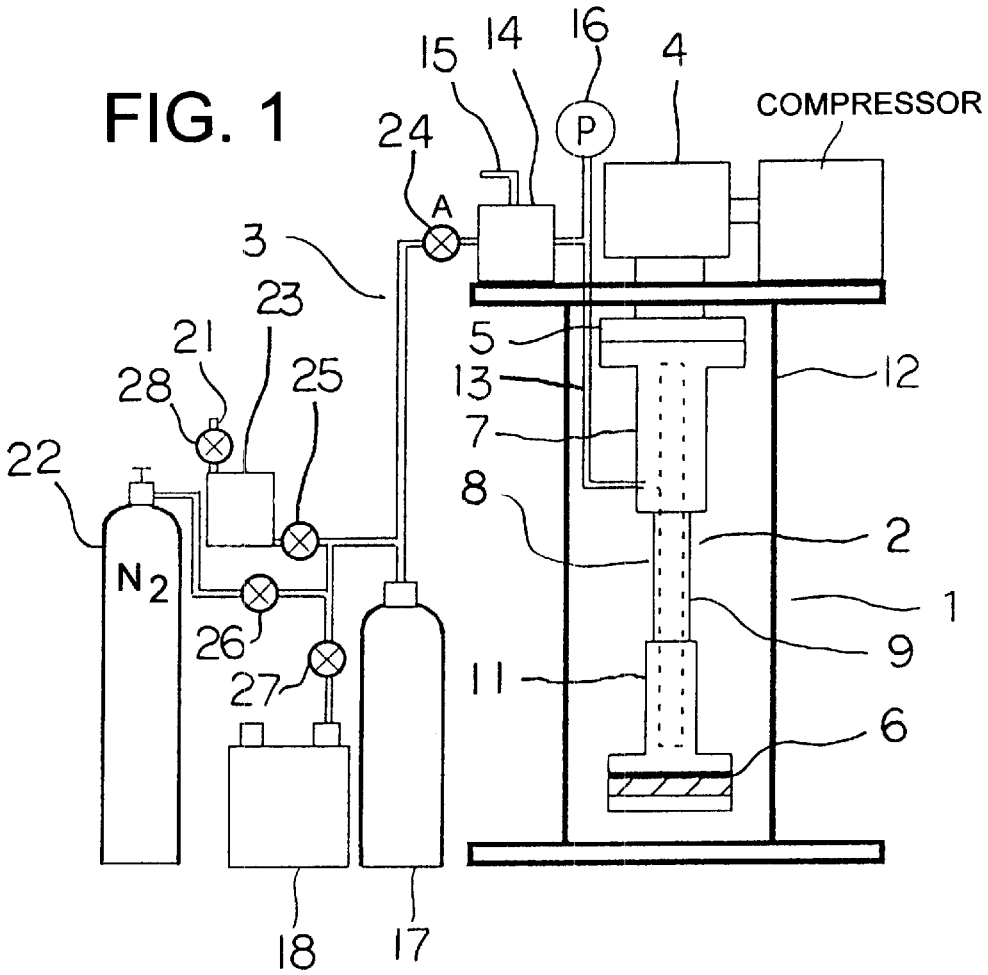
FIG. 1 is an explanatory block diagram showing a heat switch system of the invention.

In FIG. 1, a reference numeral 1 designates a heat switch system. The heat switch system 1 has a heat pipe 2 and a heating medium supply and exhaust device 3.

The heat pipe 2 is disposed between a cold head 5 of a refrigerator 4 and a superconducting member 6 to be cooled. The heat pipe 2 is a heat-transmitting element for transferring heat by reducing pressure within a pipe 9 made of aluminum, stainless steel, copper, or the like, transferring a heating medium such as Freon, ammonia, air, water through the pipe 9, and giving and receiving latent heat of vaporization. Such a heat pipe 2 itself is well known to those skilled in the art.

The heat pipe 2 has a condenser section 7, a heat transmission interrupting section 8, and an evaporator section 11. The condenser section 7 and the cold head 5 for transmitting heat therebetween and the evaporator section 11 and the superconducting member 6 for transmitting heat therebetween are housed in a cryostat 12. The heating medium supply and exhaust device 3 has a supply and exhaust pipe 13 that communicates with an inside of the pipe 9 of the heat pipe 2. To the supply and exhaust pipe 13, an exhaust pipe 15 is connected through a safety valve 14. Pressure in the supply and exhaust pipe 13 is measured by a pressure gauge 16.

To the supply and exhaust pipe 13, a buffer tank 17, a vacuum pump 18, an air intake pipe 21, and a heating medium cylinder 22 are connected. To the air intake pipe 21, an air-desiccating device 23 is connected. Reference numerals 24, 25, 26, 27, and 28 respectively designate valves. An operation of active heat control by a heat switch system 1 having the above structure is as follows. The heating medium is selected by switching between the valves 25 and 26.

If the heating medium is air, the valves 25 and 28 are opened to cause the air to flow into the buffer tank 17 temporarily, and then the valve 24 is opened to cause the air to flow into the heat pipe 2 through the supply and discharge pipe 13. A required amount of the air that has flowed into the heat pipe 2 is liquefied by a condenser section 7 and then, the valve 24 is closed. In the heat pipe 2, the air operates as the heating medium and transfers heat from the superconducting member 6 to be cooled to the cold head 5 by transferring vapor and giving and receiving latent heat of vaporization. Such an operation of the heat pipe 2 is known.

Next, in order to interrupt the heat transmission between the superconducting member 6 and the cold head 5, the valve 24 is opened. Thus, as shown in the phase diagram in FIG. 2, by shifting a state from gas-liquid two-phase coexisting state 1 to a gas-phase state 2 in the phase diagram, and then by quickly reducing pressure in the heat pipe 2 and exhausting the heat pipe 2 of the air by using the vacuum pump 18, the inside of the heat pipe 2 is brought into a vacuum heat-insulated state. Thus, the heat-transmitting function of the heat pipe 2 is stopped and the heat transmission between the superconducting member 6 and the cold head 5 is interrupted.

Figure 2:
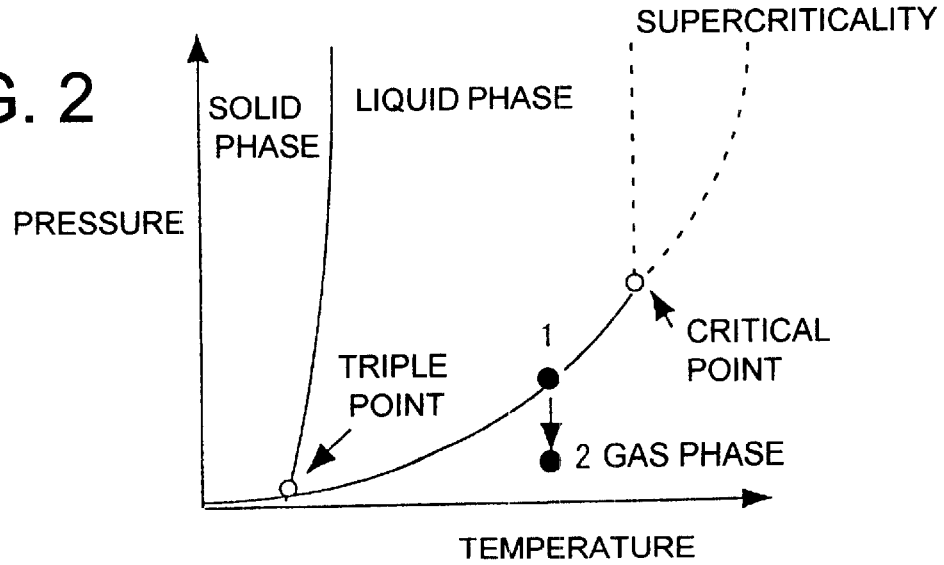
FIG. 2 is a phase diagram showing an actuation principle of a heat pipe used as a heat switch.

Air as the heating medium can be obtained easily in an environment shown in FIG. 2 and the heat pipe 2 can be easily filled with air again. When the heating medium is a gas such as nitrogen, the heating medium cylinder 22 filled with the heating medium is necessary. Especially, when the heat pipe 2 is a thermosiphon, swift switching between On (heat transmission) and off (interruption of heat transmission) is possible by miniaturization. The thermosiphon is a gravity circumfluent-type wickless heat pipe having a sealed cylindrical pipe containing a small amount of liquid (heating medium).

INDUSTRIAL APPLICABILITY

As described above, according to the active heat control heat switch of the invention, because supply and exhaust of the heating medium which are indispensable to the operation of the heat pipe are controlled to turn on and off a function of the heat pipe, the change-over switch of heat transmission which can reliably switch between heat transmission and interruption of heat transmission, does not require contact of and separation between the switch piece and the solid, can be easily incorporated into the minute electronic device, and does not generate heat or vibration during operation of the switch can be obtained.

What is claimed is:

1. A thermally controlled active heat switch system comprising:

a heat pipe able to contain a heating medium, said heat pipe being disposed between a hot zone, a cold zone, and a heating medium supply; and an exhaust device for supplying and exhausting said heating medium to and from said pipe, said exhaust device including a valve and a vacuum pump, wherein said system transmits heat and interrupts heat transmission between the hot zone and the cold zone through said heat pipe by switching between supplying the heating medium to said pipe and exhausting of said heating medium from said pipe by opening said valve thereby reducing pressure in said pipe and shifting a state of said heating medium from gas-liquid two phase coexisting state to a gas-phase state, and then exhausting said gas-phase state heating medium into the atmosphere using said vacuum pump resulting in the inside of said heat pipe being brought into a vacuum-insulated state.

* * * * *